US006805316B2

(12) United States Patent
Wojcik et al.

(10) Patent No.: US 6,805,316 B2
(45) Date of Patent: Oct. 19, 2004

(54) APPARATUS FOR SEVERING, CARRYING OR WINDING A WEB

(75) Inventors: Steven J. Wojcik, Littlechute, WI (US); John Hanson, Appleton, WI (US); Scott Bosley, Aiken, SC (US); Shane A. Emmons, North Augusta, SC (US); Jeff Greiner, Kaukauna, WI (US); Fred Marvel, Boothwyn, PA (US); John Mikulan, Sapulpa, OK (US); Walter Montgomery, Broken Arrow, OK (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/040,313

(22) Filed: Oct. 23, 2001

(65) Prior Publication Data

US 2003/0075636 A1 Apr. 24, 2003

(51) Int. Cl.[7] ..... B65H 35/08
(52) U.S. Cl. ..... 242/527.1
(58) Field of Search ..... 242/527.1, 527, 242/527.2, 527.3, 527.4, 533.4, 533.5, 533.6, 532.2

(56) References Cited

U.S. PATENT DOCUMENTS

| | | | | |
|---|---|---|---|---|
| 2,478,240 A | | 8/1949 | Christman | |
| 2,870,840 A | | 1/1959 | Kwitek | |
| 3,179,348 A | | 4/1965 | Nystand et al. | |
| 3,264,921 A | | 8/1966 | Nystrand | |
| 3,369,766 A | * | 2/1968 | Herman | 242/527.1 |
| 3,505,150 A | | 4/1970 | Andersson | |
| 3,549,097 A | * | 12/1970 | Seigh | 242/527.1 |
| 3,552,670 A | * | 1/1971 | Herman | 242/527.1 |
| 3,567,552 A | * | 3/1971 | Heuff et al. | 242/527.1 |
| 3,709,077 A | | 1/1973 | Trogan et al. | |
| 3,733,949 A | | 5/1973 | Bradley | |
| 3,771,399 A | | 11/1973 | Aterianus | |
| RE28,353 E | | 3/1975 | Nystrand et al. | |
| 3,973,452 A | | 8/1976 | Masters | |
| 4,010,666 A | | 3/1977 | Masters | |
| 4,280,669 A | | 7/1981 | Leanna et al. | |
| 4,487,377 A | * | 12/1984 | Perini | 242/532.2 |
| 4,491,045 A | | 1/1985 | Buhayar | |
| 4,687,153 A | | 8/1987 | McNeil | |
| 4,709,607 A | | 12/1987 | Buhayar | |
| 4,919,351 A | | 4/1990 | McNeil | |
| 5,249,752 A | | 10/1993 | Bertoli et al. | |
| 5,335,869 A | | 8/1994 | Yamaguchi et al. | |

(List continued on next page.)

FOREIGN PATENT DOCUMENTS

| | | |
|---|---|---|
| EP | 0607525 A1 | 7/1994 |
| EP | 1072547 A2 | 1/2001 |

OTHER PUBLICATIONS

PCT International Application, PCT/US00/03029, WO 00/47503, International Filing Date Feb. 4, 2000, International Publication Date: Aug. 17, 2000.
PCT Search Report, Dec. 19, 2002.

*Primary Examiner*—William A. Rivera
(74) *Attorney, Agent, or Firm*—Dority & Manning, P.A.

(57) ABSTRACT

A device including blades and pins is mounted for interaction with a bedroll for separating or cutting a web or sheet of material as the web travels around the circumference of the bedroll. The assembly comprises a clamp having a bottom side and a front side. Two blades having an upper surface and a lower surface are provided, with a blade spacer located between the blades, and operably connected to the clamp. A blade from a nearby chopper roll is adapted to engage the blades of the device to separate a sheet as it travels along the processing pathway. A unitary elongated mandrel that is fixed in relation to the blade, and configured to carry or move a severed web, is provided. The unitary mandrel employs a strut from which projections or pins extend in a line or row, the pins being adapted to pierce and carry the severed tail of the web to a core for gluing the tail to the core, followed by winding.

6 Claims, 8 Drawing Sheets

U.S. PATENT DOCUMENTS 5,660,350 A 8/1997 Byrne et al.
5,732,901 A 3/1998 McNeil et al.
5,755,654 A 5/1998 Schulz et al.
6,138,543 A 10/2000 Couturier et al.
6,142,407 A 11/2000 McNeil et al.
6,179,241 B1 1/2001 Ba Dour, Jr. et al.
6,513,750 B2 * 2/2003 Miller ..... 242/527.1

* cited by examiner 17
39
35
50
32
30
38a
25
38b
36
51
38c
31
38d
33
34
40
37
41

APPARATUS FOR SEVERING, CARRYING OR WINDING A WEB

BACKGROUND OF THE INVENTION

Rewinders convert large industrial parent rolls into retail-sized rolls of bathroom tissue, paper towels and the like. Center rewinders are described in U.S. Reissue Pat. No. 28,353 (hereafter "the '353 patent"). Center rewinders are adapted to wind a web on a core that is rotated by a turret.

Cut-off and transfer is a critical operation in rewinding rolls. The web must be severed to cease the winding of a roll. Then, the leading edge of the severed web must be transferred to a new core. Then, the new core must be rotated to begin winding of a new roll. These steps must be accomplished repeatedly and reliably while the web is moving at high speed. It is desirable that each roll reveals an exact sheet count so the web is wound uniformly.

In the industry, the term "bedroll" usually refers to the main winding roll of a rewinder. For example, in the '353 patent a bedroll is used with a chopper roll to sever the web after a predetermined length of web has been wound onto a log. The bedroll transfers the leading edge of the severed web to a new core in a continuous winding process. In the apparatus disclosed in the '353 patent, the severing and transfer mechanism includes a series of pins, cut-off blades, and transfer pads, all of which are mounted within the bedroll. When the severing and transfer mechanism is unlatched, the pins hold the web against the rotating bedroll while the web is severed by interaction of the chopper roll with blades that emerge from the bedroll.

Center winders commercially available in the industry and sold by Paper Converting Machine Company of Green Bay, Wis. may include moveable pins in a bedroll for holding the leading edge of the severed web, and for carrying the leading edge into position. Further, a latch mechanism may be used for retaining the pins in an inoperative position until the web is to be severed. A cut-off knife may be fixed in a chopper roll and the cut-off blade in the bedroll may be movably mounted.

Bedroll blade and pin assemblies must be changed periodically for maintenance. In such operations, it is desirable to replace or adjust assemblies without adversely affecting critical setup dimensions and fine tolerances. In conventional designs, the blade assembly includes clamps that must be loosened on the cross-shaft to replace parts. The setup dimensions between bedroll pins, pads and the mandrel must be reestablished each time the parts are changed using conventional apparatus. The top bedroll cover usually must be removed to access such mechanical assemblies. It is common, therefore, for a large amount of machine "down time" to be incurred in changing and re-setting such blades and pins. Furthermore, there exists a risk of error in setting the clearance between the pins and the mandrel, which can be a time consuming and difficult problem.

U.S. Pat. No. 4,280,669 (the "'669 patent") discloses an automatic web rewinder for a tensioned web. In FIG. 10 of the '669 patent, a configuration that employs individual pins is shown. Such pins must each be replaced separately, resulting in a relatively long and difficult maintenance procedure that must be periodically performed on such apparatus.

What is needed in the industry is an improved design for a blade and pin assembly that facilitates a change of pins and blades without undesirably affecting critical setup tolerances. Furthermore, an apparatus and method that minimizes the amount of labor involved in changing pins and/or blades would be desirable. An assembly that can reduce the amount of down time incurred in repair operations would be useful.

SUMMARY OF THE INVENTION

The invention comprises an apparatus or device and method for severing and carrying a sheet or web in a winding operation. In one embodiment of the invention, a first blade and a second blade are provided, in which the first blade and second blade are connected and spaced apart a predetermined distance to form a gap. The first and second blades are adapted to bear against the surface of a web, further wherein the gap is sized so as to receive another blade or tearing member between the first blade and second blade in severing a web or sheet.

Furthermore, in one application of the invention, a unitary elongated mandrel is connected to at least the first blade, the mandrel comprising a plurality of spaced pins projecting from the mandrel and spaced along its length, the pins being configured for piercing and carrying a severed web.

The device of the invention typically is mounted within a bedroll which rotates to feed a sheet or web. The sheet may include paper, textiles, synthetics, or other fabrics or webbing. In many instances, the sheet or web fed by the bedroll previously has been perforated, so that tearing or severing requires relatively little force. The device also may include a spacer between the first blade and second blade to set the space of the gap at a predetermined distance that is most effective for severing or tearing the sheet.

In many applications of the invention, a unitary elongated mandrel having a series of pins along its length is configured to project from the exterior surface of the bedroll at a point in time just prior to the web being severed, to hold the web in place against the bedroll once the web has been separated. A pin assembly may be movable from a first position in which pins are held beneath the outer circumference of the bedroll, to a second position in which all or some of the pins project from the outer surface of the bedroll.

The device of the invention also may include pins that are oriented in substantially the same direction. Replacement of the unitary elongated mandrel with its associated pins usually may be accomplished by mounting the unitary elongated mandrel upon the front side of the clamp.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

Figure 1:
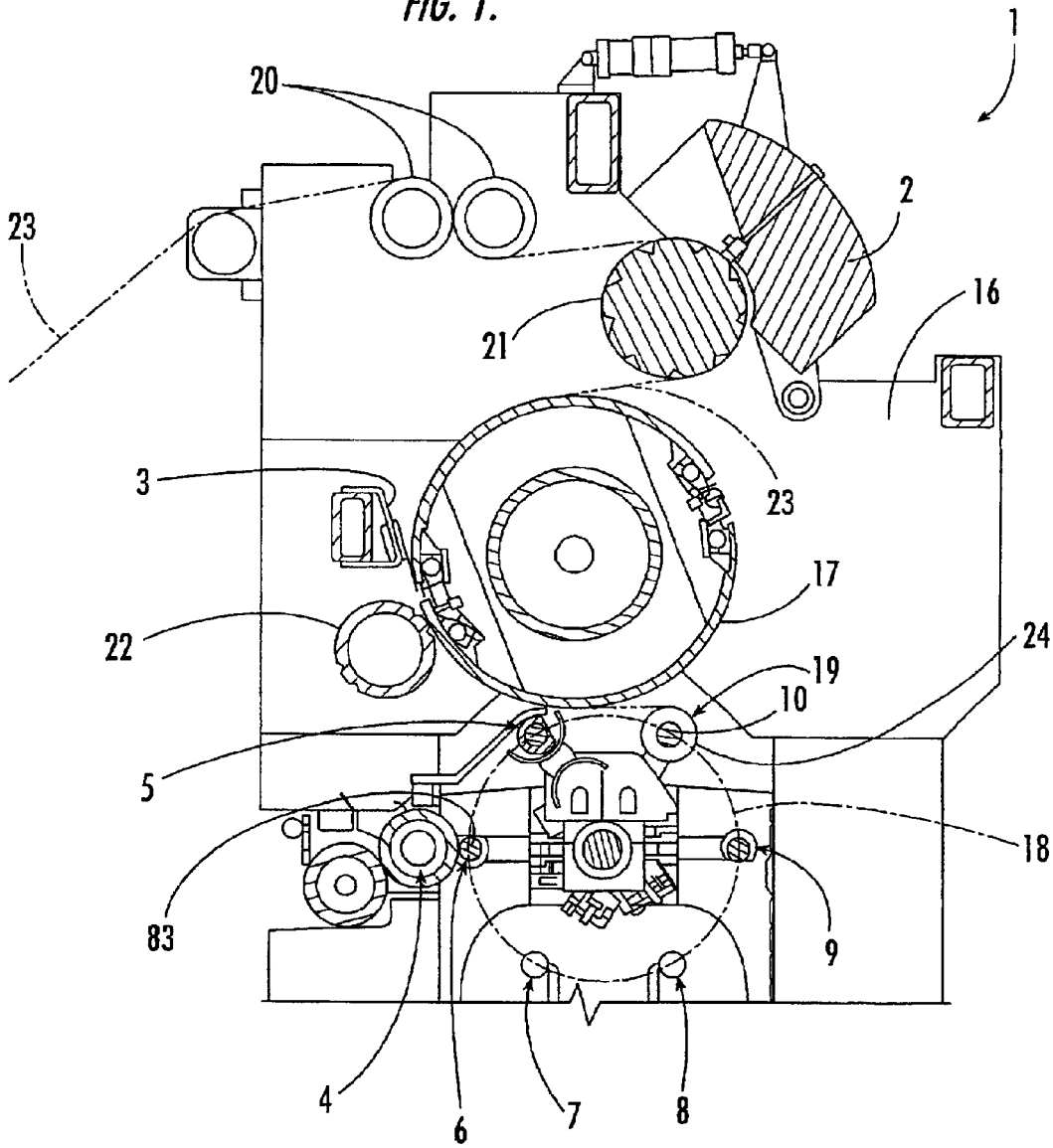
FIG. 1 illustrates a center rewinder as employed in the practice of the invention.

FIG. 1 shows a portion of a center rewinder 1 that may be employed in the practice of the invention. It should be noted, however, that the invention also may be employed with surface rewinding equipment, and is not limited to the specific center rewinding apparatus of FIG. 1.

Rewinder 1 includes a frame 16 and a bedroll 17 rotatably mounted in the frame. A turret assembly 18 is rotatably mounted in the frame below the bedroll 17. The turret assembly 18 further includes a plurality of rotating mandrels such as winding position mandrel 19 where paper is wound upon core 10. After winding, the turret assembly 18 rotates, moving so that position 9 (log cutting position), position 8 (log stripping position), and position 7 (core loading position) are taken in sequence.

An adhesive applicator apparatus 4 applies transfer adhesive onto new cores 83 at glue applicator position 6 before each winding cycle. Cores are located at each position of the turret assembly (see core 10, for example, in FIGS. 6–8, or core 83 in FIG. 1), and they are rotated is at predetermined time intervals to carry on each step of the tissue winding process. At glue pre-spin position 5, the core which has moved up from glue applicator position 6, with glue on its outer surface, is pre-spun to bring it up to a high rotational speed. This speed may be as high as 4,000 rpm, or in some cases even as high as 6,000–7,000 rpm, depending upon the particular product produced and process utilized.

Bedroll 17 delivers the web 23 (as further described below in connection with FIGS. 6–8) to the glue pre-spin position 5 just at the point at which that turret assembly 18 is placed in rotation towards the winding position 19, and the free end of the severed web 23 is carried in a counterclockwise direction for some distance around the bedroll 17, and attached to a new core 83 (FIG. 8) as further described below. Of course, other embodiments of the invention could employ a bedroll 17 that rotates in a clockwise direction, and the invention is not limited to any particular path of rotation of any roll, either clockwise or counterclockwise.

Figure 2:
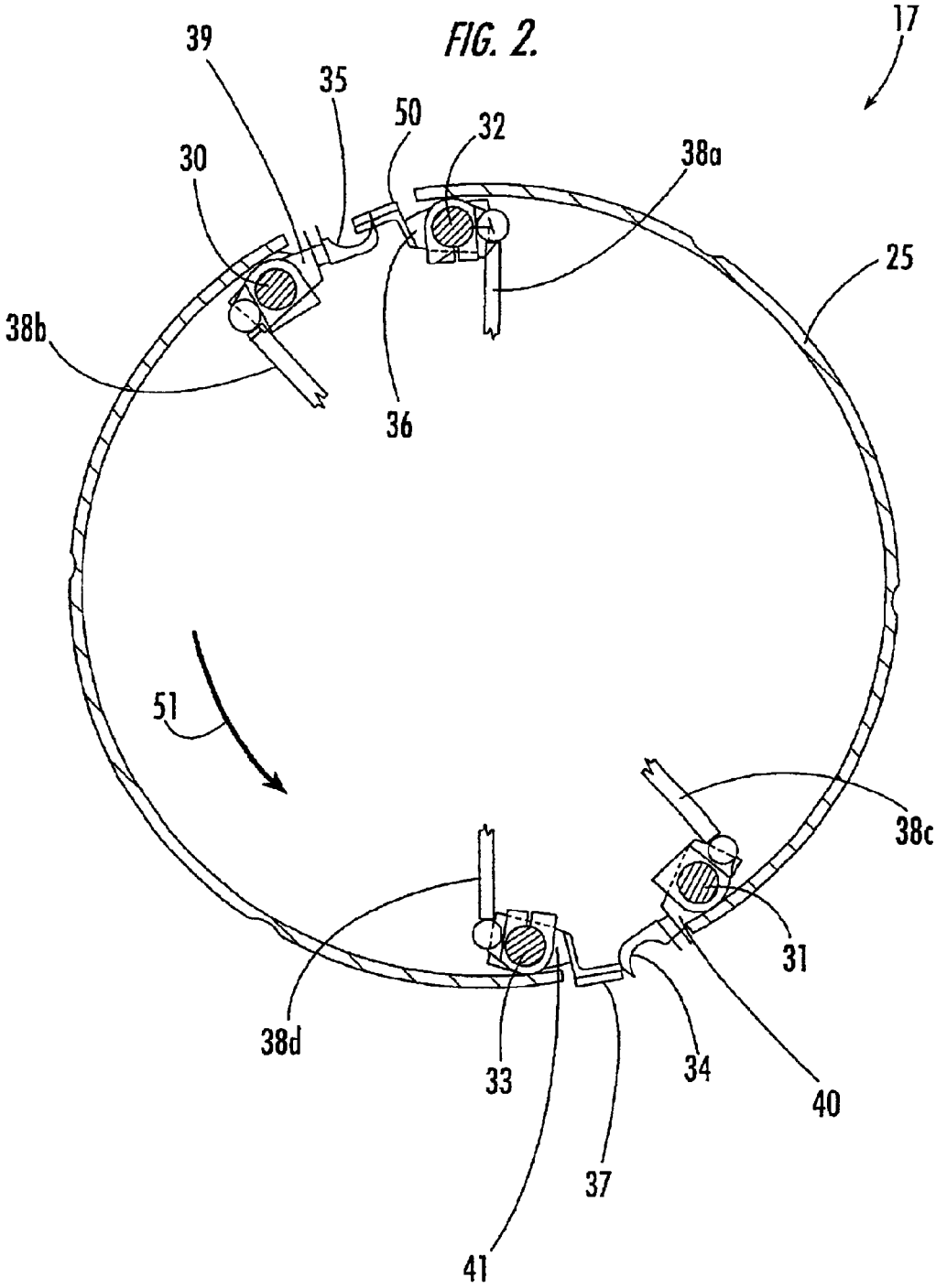
FIG. 2 is a transverse sectional view of the bedroll, which is shown in the center of FIG. 1.

In FIG. 2, a closer view of the bedroll 17 of FIG. 1 is seen in which a pair of transfer pin pivot shafts 30 and 31 are rotatably supported within the bedroll 17. The transfer pin pivot shafts 30 and 31 extend the length of the bedroll, and are seen in cross-section in FIG. 2. A plurality of transfer pins 35 and 34 are clamped to each of the transfer pin pivot shafts 30 and 31, respectively. For example, transfer pin 34 is clamped to transfer pin pivot shaft 31 by a clamp 40. Transfer pad 37 is clamped to transfer pad pivot shaft 33 by way of clamp 41. On the opposite side of the bedroll, clamp 36 securely holds transfer pad 50, and is connected to transfer pad pivot shaft 32. Likewise, transfer pin pivot shaft 30 is securely connected to clamp 39 to hold the transfer pin 35 in position. Of course, the invention is not limited to bedrolls having any particular number of cut-off and transfer assemblies, and less or more assemblies than that shown in FIG. 2 could be employed in the invention. Push rods, 38*a*, 38*b*, 38*c*, and 38*d* are provided in operable connection to clamps 36, 39, 40, and 41, respectively. An outer cylindrical shell 25 of the bedroll 17 is shown in FIG. 2. Counterclockwise rotation of the bedroll 17 is shown by arrow 51. It is the push rods 38*a–d* which activate respective transfer pin pivot shafts 30–33, which in turn provide energy and movement to both transfer pads 37 and 50, and the transfer pins 34–35.

Figure 3:
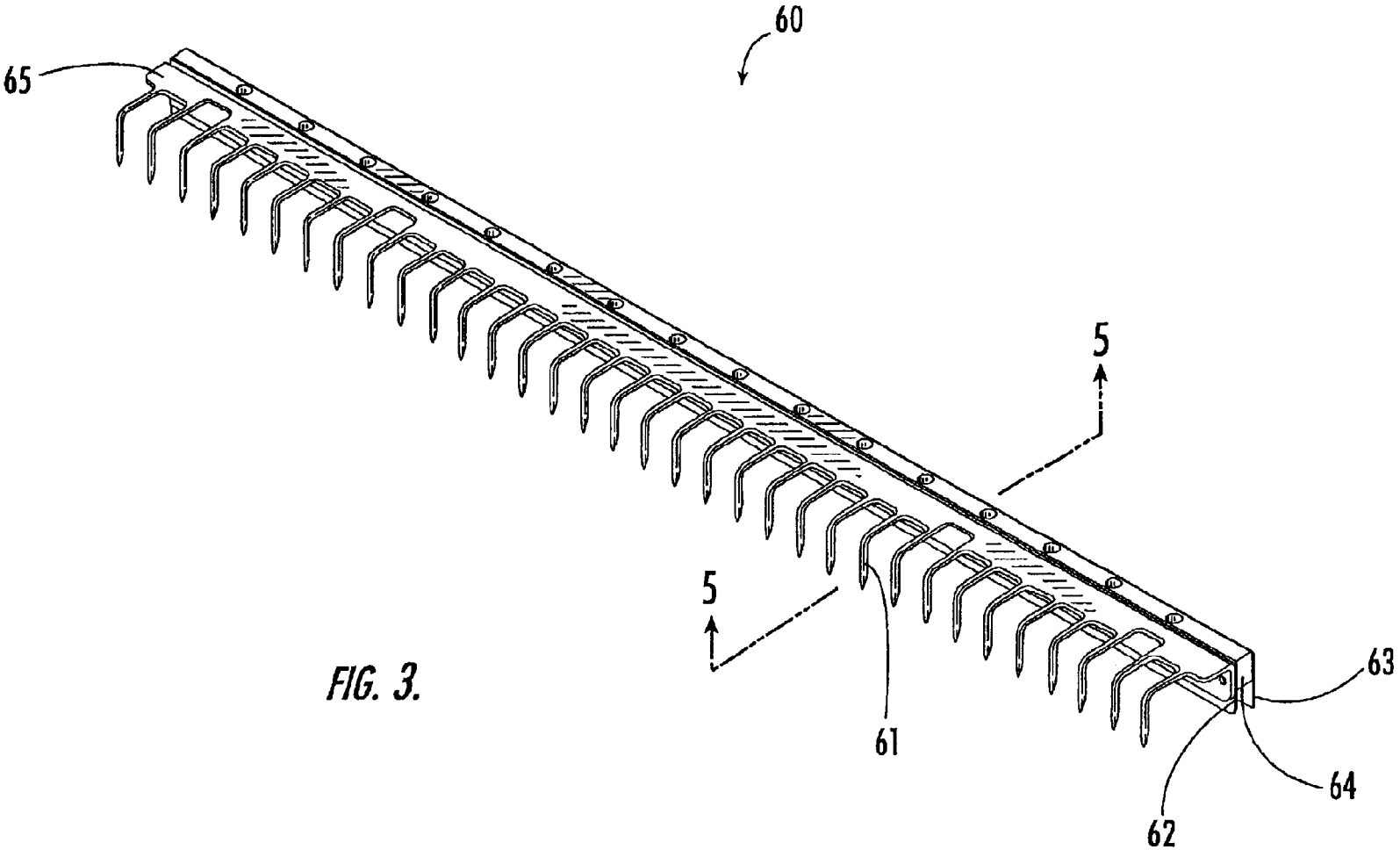
FIG. 3 is a perspective view of a pin assembly having a unitary mandrel with pins projecting from the mandrel.

FIG. 3 presents one embodiment of the invention in which pin assembly 60 comprises a plurality of pins 61 in an integrated unit. That is, a first blade 62 and a second blade 63 are secured and separated by a spacer 64 that is provided between first blade 62 and second blade 63. A unitary elongated mandrel 65 is shown having an integrated plurality of pins or projections extending therefrom, such as pin 61. The web engaging assembly 70 (see FIG. 5) is movably mounted within the bedroll, and is movable between a first position in which the web engaging assembly is inward of the outer surface of the bedroll 17 and a second position in which the web engaging assembly 70 projects beyond the outer surface of the bedroll 17 in contacting the web 23.

The embodiment shown in FIG. 3 shows 34 total pins, each of which are similar in structure and function to pin 61. However, the number of pins employed on a particular pin assembly 60 will be dependent upon the width of the web 23 on the bedroll 17, and the physical characteristics of the web 23. There must be enough pins 61 to ensure that the web does not pull through but indeed is carried by the pin assembly 60 when the web engaging assembly 70 (see FIG. 5) moves beyond the outer circumferential surface of the bedroll 17, as further discussed below in connection with FIGS. 6–8. In any event, the pins (such as pin 61) need not be identical, but should be configured for piercing and carrying the web 23 a distance to mate with a new core 10, as further described below in FIGS. 6–8.

In most instances, the unitary elongated mandrel 65 could carry 5–20 pins, and be in two or three pieces, providing a total pin count of between about 15 and 120. In other circumstances, it might be advantageous to provide less than 15 pins or more than 120 pins in total, but usually about one pin for every 1–5 inches of cross directional width of web 23 is sufficient.

A "unitary" structure of unitary elongated mandrel 66 as defined herein is a structure which does not rely upon mounting and bolting each pin separately to the unitary elongated mandrel 65. The unitary elongated mandrel 65 may be a molded integrated portion of high impact plastic or metal that carries multiple pins, which makes replacement of pin assembly 60 convenient. By "integrated", it is meant that the pins are not separately mountable on the mandrel, but are joined to the mandrel in a continuous, uninterrupted structure, without the necessity for mounting hardware associated with each individual pin.

Figure 4:
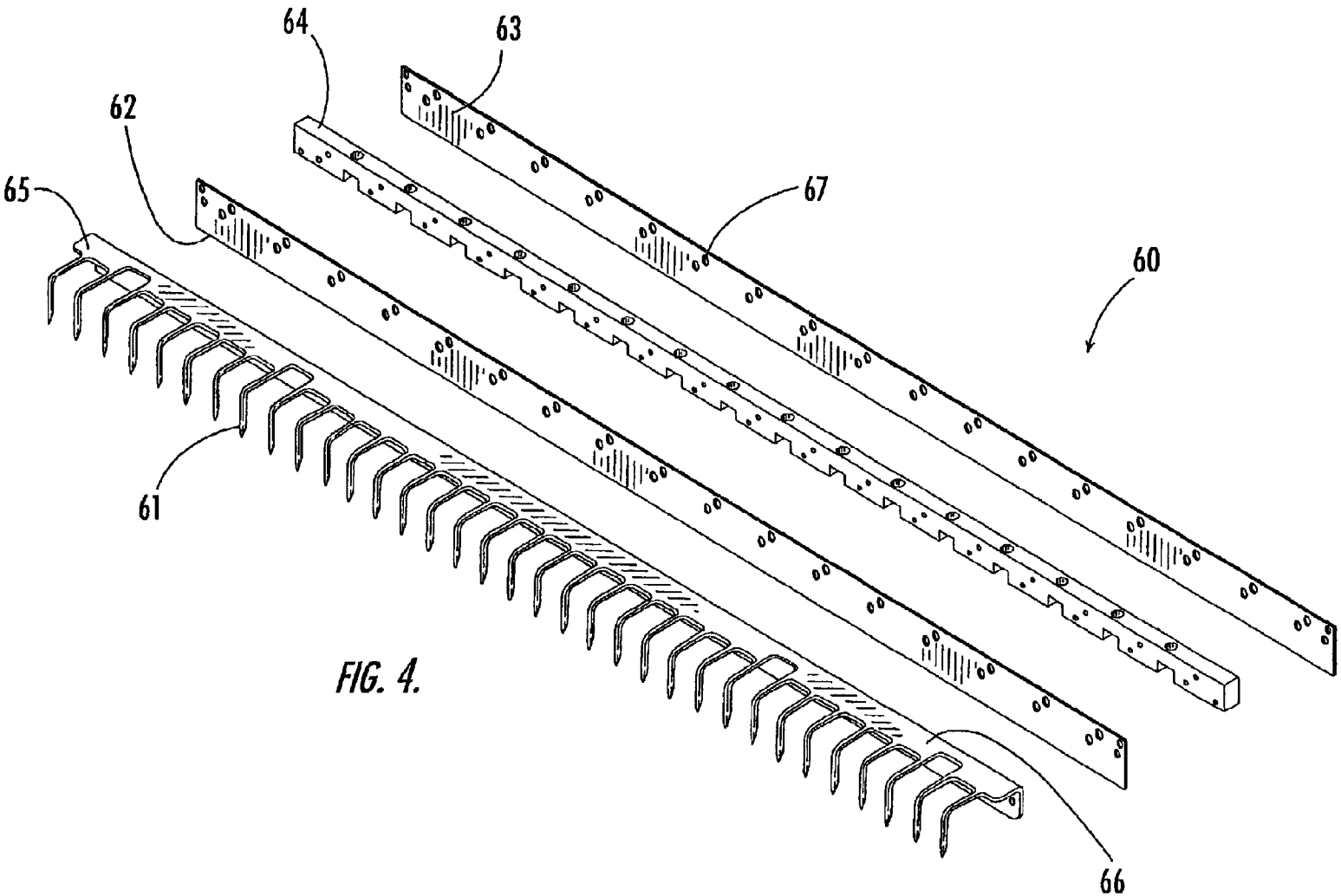
FIG. 4 shows an exploded view of the pin assembly of FIG. 3 in which blades are separated from the mandrel for illustrative purposes.

FIG. 4 shows an exploded view of the pin assembly 60 (previously shown in FIG. 3) in which second blade 63, spacer 64, first blade 62 and unitary elongated mandrel 65 are separated. In that view, one can see alignment holes 67 along the length of the pin assembly 60 which are used to receive a alignment pins, such as alignment pin 73*a* (shown in FIG. 5).

Figure 5:
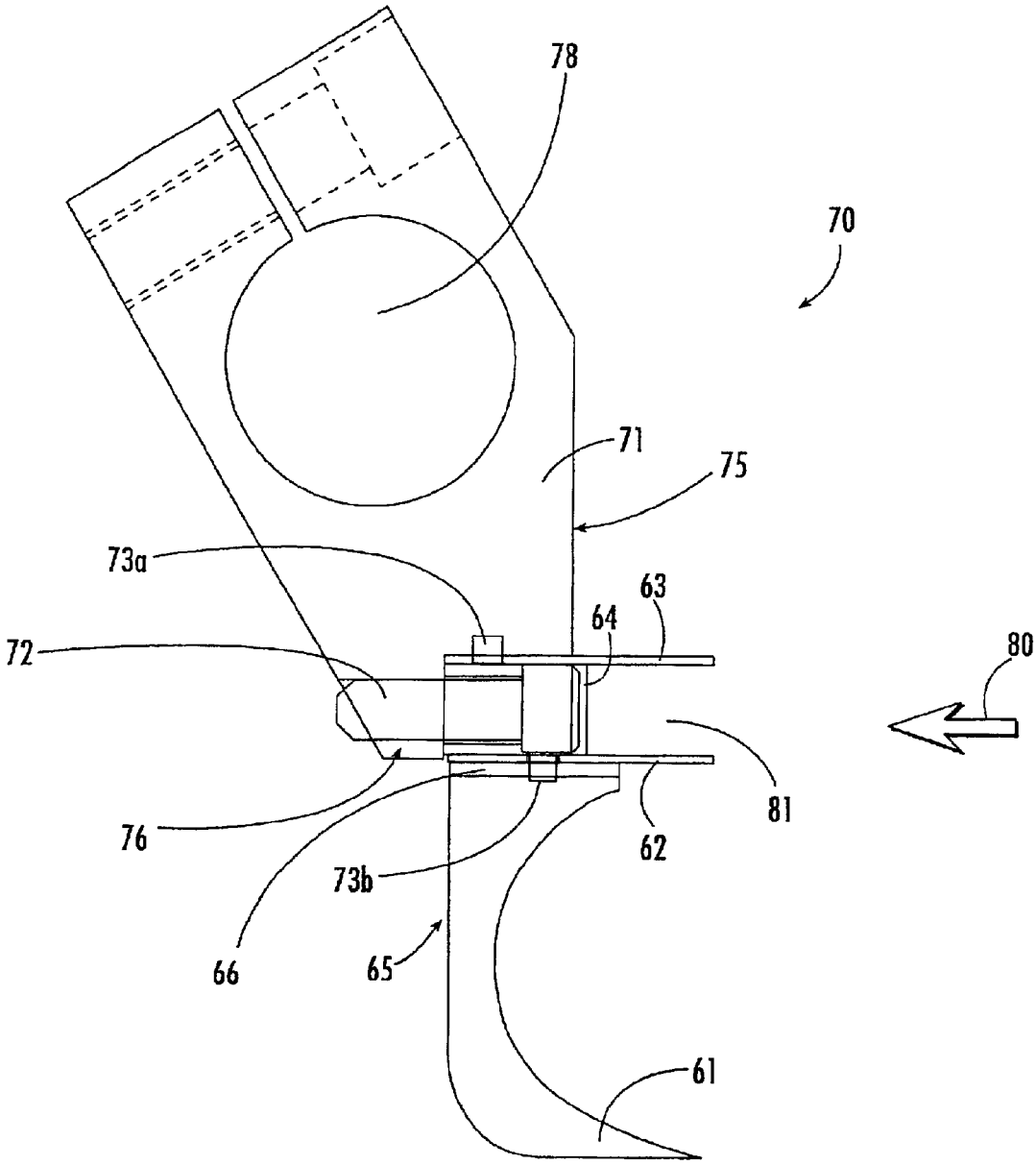
FIG. 5 reveals a cross-sectional side view of a pin of the assembly as taken along lines 5—5 of FIG. 3, further showing the front mounting of the mandrel or pin assembly upon a clamp in a bedroll.

FIG. 5 shows a partial cross-sectional view of a web engaging assembly 70 as taken along lines 5—5 of FIG. 3. An aperture 78 for a transfer pin pivot shaft 30 or 31 is shown near the top of FIG. 5. The clamp 71 of FIG. 5 is not shown, however, in FIG. 3 or 4. The web engaging assembly 70 includes a clamp 71 securely connected to the unitary elongated mandrel 65. The spacer 64 provides a predetermined and appropriate gap 81. The gap 81 functions to receive a severing mechanism, such as for example a chopper blade 82 (see FIGS. 6–7) when the web is severed, as further described below.

Thereaded connector 72 facilitates mounting of the web engaging assembly 70 for attachment to the clamp 71 from the front side (indicated by arrow 80 showing mounting direction), rather than from the bottom, which reduces the time and effort required to change out wom components with new components. The front surface 75 of the clamp 71 is shown in FIG. 5. The bottom surface 76 of the clamp is shown as well. Alignment pins 73*a*–*b* are shown near the center of FIG. 5, and they assist in holding the first blade 62 and the second blade 63 in position with the appropriate gap 81 there-between.

Figure 6:
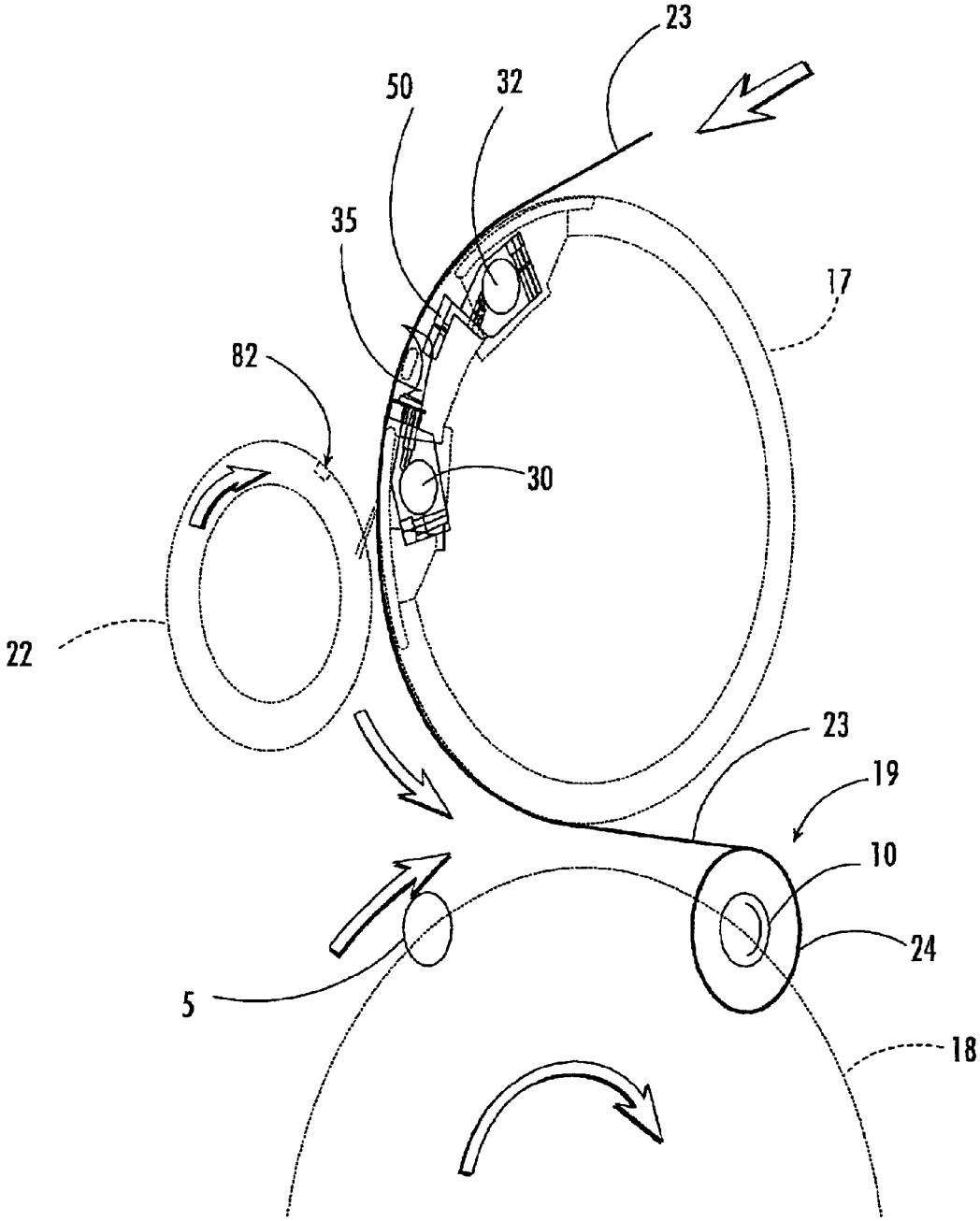
FIG. 6 shows a perspective view of pins impaling the web just prior to web separation, wherein web separation occurs by interaction between the chopper roll and the bedroll.
Figure 7:
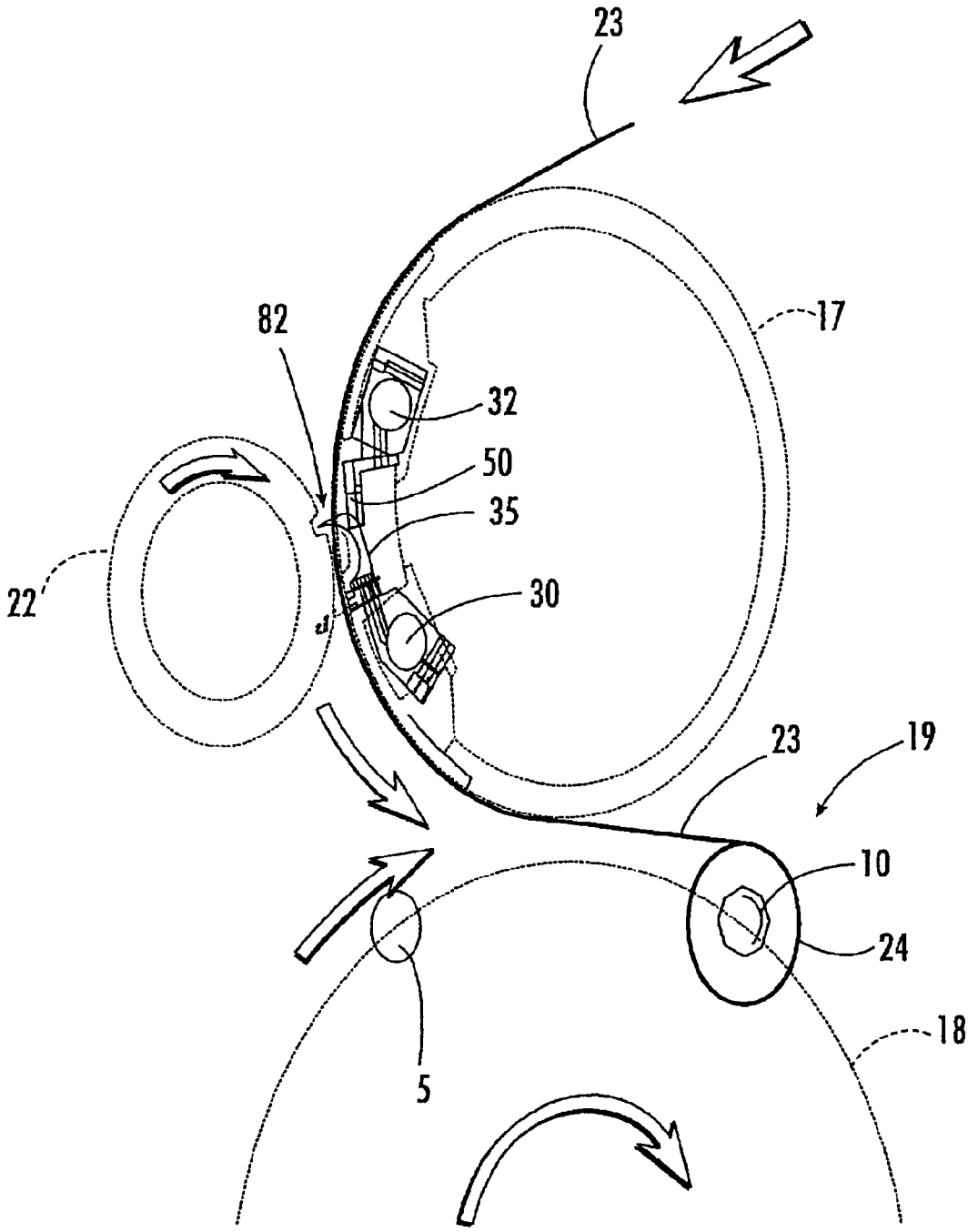
FIG. 7 is a perspective view showing the position of the bedroll a moment after that shown in FIG. 6 as the web is severed along a perforation by entry of a chopper roll blade in between blades of the bedroll.
Figure 8:
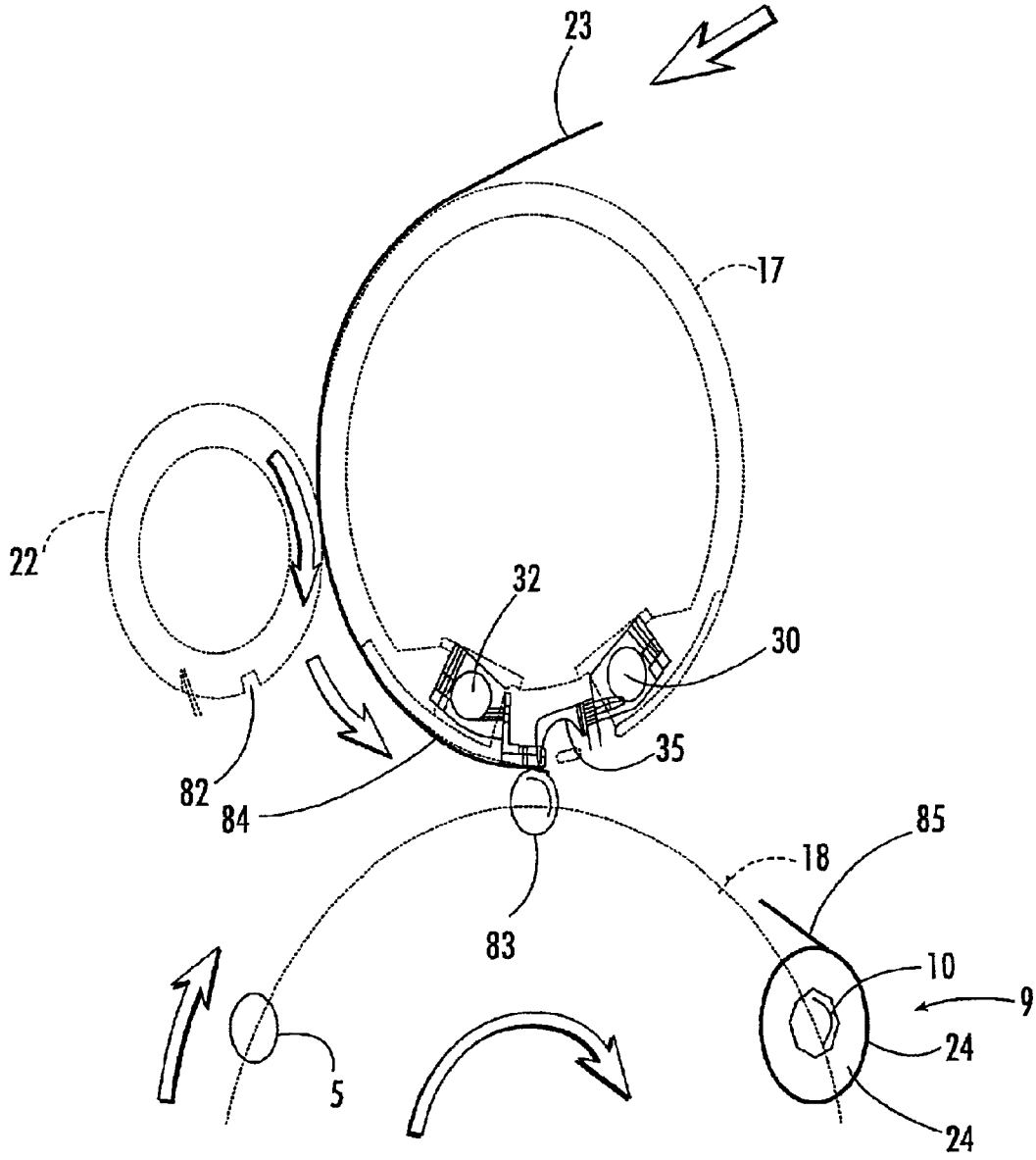
FIG. 8 illustrates a view of the carrying and transfer of the leading edge of the upstream portion of the web, a moment after that shown in FIG. 7, wherein the web is moved from the bedroll to a new core 83 on the turret assembly.

In FIGS. 6–8, a step-by-step view of the high speed severing, carrying and transfer of the web 23 is shown. A web material 23, shown on the upper portion of FIG. 6, is advanced by draw rolls 20 around a perforator 21 (see FIG. 1) to the bedroll 17. The perforator 21 forms longitudinally spaced transverse lines of perforation (not shown) in the web 23. Not all applications of the invention will use perforations or perforator 21, but most paper toweling and toilet tissue applications include perforations in the final product. Clearly, the invention is not limited to only those applications that use perforated webs. In general, the surface speed of the bedroll approximately matches the speed of the web 23, at the point where the web 23 engages bedroll 17.

As a next step, as shown in FIG. 6, the pins (such as transfer pins 35) are activated by movement of transfer pin pivot shaft 32, and they move from a first position in which the pads 50 are resting in between the pins to a second position in which pads 50 project from the outer circumferential periphery of the bedroll 17. Then, the transfer pins 35 engage web 23 by piercing the web, as shown in FIG. 6.

The chopper roll 22 (see FIG. 7) deploys a severing mechanism which in some embodiments comprises a chopper blade 82 extending out from the periphery of the chopper roll 22 and projecting at least partly into gap 81 (gap 81 not shown in FIG. 7, but shown in FIG. 5) between first blade 62 and second blade 63 of the blade assembly 70. Passage of the chopper blade 82 into the gap tears the web 23 which is stretched across the first blade 62 and second blade 63 on the surface of the bedroll 17.

Once the web 23 is separated or severed, it forms an upstream portion 84 and a downstream portion 85, as shown in FIG. 8. In FIG. 7, the moment immediately following the separation of the web 23 is shown. FIG. 8 shows a view of the carrying and transfer of the leading edge of the upstream portion 84 of the web 23, wherein the web 23 is moved from the bedroll 17 to a new core 83 on the turret assembly 18. Transfer pins 35 carry the web 23 and hold it securely to the outer circumferential surface of the bedroll 17 until it is taken up on core 10 to form a log 24 at winding position 19.

Typically, the pin assembly 60 of the invention may be installed with a setup dimension of 0.090 inches (see FIG. 3) between the pins (such as pin 61), but other gap widths also may be employed. Holes for mounting screws are counterbored in the spacer 64 at spaced intervals, which may be about 1.5 inches, but can less or more, depending upon the particular configuration desired. A range of 0.5 to 4 inches is reasonable for many applications. It is sometimes feasible to provide slight cross-machine direction adjustments of the clamp 71 so that one standard spacer may be used on several winders.

One winder that may be employed in the practice of the invention is a Paper Converting Machine Corporation (PCMC) "Centrum" or "250 Series" continuous winder. In most cases, both blades included in the pin assembly 60 (shown in FIG. 4) are essentially identical in shape and size, but it is not required that they be identical.

A 0.05 inches offset in the blade edges may be used advantageously with the alignment of pins 61, but greater or lesser offsets may be employed, ranging from about 0.01 to about 0.15, or more. For some embodiments, the web engaging assembly 70 includes a distance between the first blade and the second blade of between about 0.03 and 0.07 inches, and most preferably about 0.05 inches. Furthermore, in at least one embodiment of the invention each of the four web engaging assemblies 70 on a bedroll are identical to each other. In this way, it is possible to provide one blade system or type that can be used as a common spare for all continuous winders of the stated design, reducing inventory requirements for such parts.

When the bedroll 17 is rotated such that the web engaging assembly 70 is at the three o'clock position (i.e., three o'clock position as on a clock face), the pin assembly 65 may be mounted to the clamps 71 (using threaded connector 72) in a horizontal direction (i.e.: as along arrow 59 in FIG. 5). Thus, in that way it is possible to provide maintenance and replacement of the mounting hardware which is accessible without removing bedroll covers (not shown). Removal of a unitary elongated mandrel 65 typically requires removal of a center bedroll cover (not shown).

In the general application of the invention, a web engaging assembly may include a web engaging member, such as unitary elongated mandrel 65 (as one example), in which the pin assembly 60 may be moved between a first position (in which the pin assembly 60 is inward of the outer surface of the winding roll) and a second position in which the pin assembly 60 projects beyond the outer surface of the bedroll 17, and is engaged with the web 23. The pin assembly 60 may act to carry the web in the cutting and winding process.

It should be understood that the invention is not limited to any particular bedroll configuration. For example, the invention could be employed with conventional latch mechanisms in which a center rewinder is used to retain the severing and transferring mechanism in an inoperative position until the proper length of web has been wound onto the log. In such systems, a latch mechanism with a severing and transfer mechanism could be used which employs pins, cut-off blades, and transfer pads, all of which are movably mounted within the bedroll. In some applications, the invention could be used in those configurations in which a transfer mechanism is unlatched, and pins hold the web against a rotating bedroll while the web is severed by a chopper roll. In such applications, the transfer pads could thereafter urge the leading end of the severed web against a new core. Thus, the embodiment shown in FIG. 2, which employs push rods 38*a*–*d*, is only one illustrative configuration of a bedroll which could employ the invention. Some applications may use a solenoid to position a cam follower to release the latch mechanism. There are many such possibilities, and the invention is not limited to any particular configuration.

It should be recognized that the invention is not limited to only center rewinders, but may be employed with essentially any type of winding device made by any manufacturer that employs cut-off using a plurality of pins for engaging a sheet. It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A web severing and carrying apparatus including a mandrel that comprises a pin assembly projecting therefrom, comprising:

a bedroll rotatably supported on a frame for rotation about an axis, the bedroll having an outer surface for contacting a web, a mandrel with a pin assembly projecting therefrom, the pin assembly being movably mounted on the bedroll, the pin assembly being movable between a first position in which the pin assembly is inward of the outer surface of the bedroll and a second position in which the pin assembly projects beyond the outer surface of the bedroll for contact with the web, wherein the pin assembly comprises at least two blades configured for severing a web and having multiple spaced pins along its length, in which the pins are configured for piercing and carrying the web; and a clamp for mounting the mandrel to the bedroll, the clamp including a front surface that faces the outer surface of the bedroll when the pin assembly is inward of the outer surface, the mandrel being connected to the front surface of the clamp.

2. The apparatus of claim 1 in which the pin assembly further comprises pads adapted for disengaging the web from said pins.

3. The apparatus of claim 2 in which the mandrel is configured to be mountable and removable from said assembly as a one-piece unit.

4. The apparatus of claim 1 in which the pin assembly comprises pins having a long axis, the pins being substantially parallel to each other along their long axis, further wherein the pin assembly is mounted to the blade assembly by a connector, therein the connector is aligned generally perpendicular to the long axis of the pins when secured to the pin assembly, thereby facilitating the mounting of the pin assembly upon the front side of the clamp.

5. The apparatus of claim 4 in which the apparatus further wherein the distance between the first blade and second blade is between about 0.03 and about 0.07 inches.

6. The blade assembly of claim 4 in which the distance between the first blade and second blade is about 0.05 inches.

* * * * *